US009673506B2

(12) United States Patent
Asou et al.

(10) Patent No.: US 9,673,506 B2
(45) Date of Patent: Jun. 6, 2017

(54) ANTENNA DEVICE AND MANUFACTURING METHOD THEREOF

(71) Applicant: TDK CORPORATION, Tokyo (JP)

(72) Inventors: Hirohumi Asou, Tokyo (JP); Kosuke Kunitsuka, Tokyo (JP); Toshifumi Komachi, Tokyo (JP); Toshio Tomonari, Tokyo (JP)

(73) Assignee: TDK Corporation, Tokyo (JP)

( * ) Notice: Subject to any disclaimer, the term of this patent is extended or adjusted under 35 U.S.C. 154(b) by 70 days.

(21) Appl. No.: 14/713,246

(22) Filed: May 15, 2015

(65) Prior Publication Data

US 2015/0340754 A1 Nov. 26, 2015

(30) Foreign Application Priority Data

May 21, 2014 (JP) ..... 2014-105278

(51) Int. Cl.

| | |
|---|---|
| ***H01Q 7/08*** | (2006.01) |
| ***H01Q 1/22*** | (2006.01) |
| ***H01Q 7/00*** | (2006.01) |
| ***H01Q 7/04*** | (2006.01) |
| ***H01F 5/00*** | (2006.01) |
| ***H01F 27/36*** | (2006.01) |
| *H01Q 5/00* | (2015.01) |
| *H01Q 1/48* | (2006.01) |
| *H01Q 1/24* | (2006.01) |
| *H01Q 1/38* | (2006.01) |
| *H01F 38/14* | (2006.01) |

(52) U.S. Cl.

CPC ..... *H01Q 1/2225* (2013.01); *H01F 5/003* (2013.01); *H01F 27/365* (2013.01); *H01Q 7/00* (2013.01); *H01Q 7/04* (2013.01); *H01F 38/14* (2013.01); *H01Q 1/243* (2013.01); *H01Q 1/38* (2013.01); *H01Q 1/48* (2013.01); *H01Q 5/00* (2013.01); *H01Q 7/08* (2013.01); *Y10T 29/49018* (2015.01)

(58) Field of Classification Search

CPC H01Q 7/08; H01Q 1/243; H01Q 5/00; H01Q 1/48; H01Q 7/00

USPC ..... 343/788, 848, 860, 866, 867, 702, 722

See application file for complete search history.

(56) References Cited

U.S. PATENT DOCUMENTS

2010/0182144 A1* 7/2010 Yamashita ..... G06K 19/07749 340/539.11

FOREIGN PATENT DOCUMENTS

| | | |
|---|---|---|
| JP | 2008-117944 A | 5/2008 |
| JP | 201063006 | 3/2010 |
| KR | 1020070113770 | 11/2007 |

* cited by examiner

*Primary Examiner* — Joseph Lauture

(74) *Attorney, Agent, or Firm* — Young Law Firm, P.C.

(57) ABSTRACT

Disclosed herein is an antenna device that includes an antenna coil having a planar coil pattern, a magnetic sheet that covers one main surface of the antenna coil, and a resin layer provided on the other main surface of the antenna coil and along the coil pattern. The resin layer is substantially the same planar shape as the planar coil pattern.

23 Claims, 8 Drawing Sheets

ANTENNA DEVICE AND MANUFACTURING METHOD THEREOF

BACKGROUND OF THE INVENTION

Field of the Invention

The present invention relates to an antenna device and a manufacturing method thereof and, more particularly to an antenna device suitable for NFC (Near Field Communication) system and a manufacturing method thereof.

Description of Related Art

In recent years, a mobile electronic apparatus such as a smartphone is provided with an RFID (Radio Frequency Identification, i.e., individual identification by radio waves) system and further provided with, as a communication means of the RFID, an antenna device for performing near field communication with a reader/writer. For example, a conventional antenna device described in Japanese Patent Application Laid-Open No. 2008-117944 has a base substrate made of a plastic film, an antenna coil formed on the base substrate, a metallic shield plate provided at a position overlapping the antenna coil in a planar view, and a magnetic core member provided between the antenna coil and metallic shield plate. Such an antenna device is accommodated in a casing of a mobile electronic apparatus such as a smartphone and is disposed on a surface of a battery pack or a surface of a printed circuit board.

However, recently, a reduction in thickness of the mobile electronic apparatus is highly required, and a further thickness reduction is required for the antenna device itself. Further, in a case where the antenna device is mounted on a surface of a heating element such as a battery pack, the base substrate may block heat radiation from the battery pack because the antenna coil is supported on the base substrate. Further, because the base substrate is made of a dielectric material, an inter-line capacitance of the antenna coil becomes large due to an intervention of the dielectric material between lines of the antenna coil, making it difficult to achieve frequency matching.

SUMMARY

It is therefore an object of the present invention to provide an antenna device having a very small thickness and having excellent heat radiation characteristics and excellent antenna characteristics, and a manufacturing method thereof.

To solve the above problems, an antenna device according to the present invention includes an antenna coil having a planar coil pattern, a magnetic sheet that covers one main surface of the antenna coil, and a resin layer provided on the other main surface of the antenna coil and along the coil pattern.

According to the present invention, the antenna coil is supported by the magnetic sheet, and a resin support film is not provided, whereby a reduction in thickness of the antenna device can be achieved. Further, the antenna coil is covered by the resin layer and, thus, the surface of the antenna coil can be protected thereby. Further, because the support film is not provided, heat radiation from the heating body is not blocked by the support film even when the antenna device is provided on the surface of the heating body. Further, the support film having a high dielectric constant is removed and absent, so that it is possible to solve the problem that it is difficult to achieve frequency matching of the antenna coil due to a large line capacitance of the coil by the support film.

In the present invention, the antenna coil is preferably bonded to one main surface of the magnetic sheet via an adhesive layer. According to this configuration, the antenna coil that has previously been formed on the support film can be transferred to the surface of the magnetic sheet, thus allowing the antenna coil to be reliably formed on the magnetic sheet.

In the present invention, the magnetic sheet is preferably provided so as to avoid an area overlapping an outer peripheral end and an inner peripheral end of the antenna coil in a planar view. With this configuration, it is possible to easily achieve electrical connection between the antenna coil and a communication circuit such as an NFC chip.

In the present invention, a metallic body is may positioned on the other main surface side of the magnetic sheet. According to this configuration, the magnetic sheet is interposed between the metallic body and the antenna coil, so that it is possible to reduce influence of the metallic body on the antenna coil.

In the present invention, a printed circuit board may be positioned on the other main surface side of the magnetic sheet. According to this configuration, a communication circuit can be constructed on the printed circuit board, facilitating electrical connection between the communication circuit and the antenna coil.

In the present invention, the resin layer preferably contains metal that acts as a catalyst when the antenna coil is formed by plating. According to this configuration, the antenna coil can be formed by plating on the surface of the resin layer. By bonding the formed antenna coil to the surface of the magnetic sheet, the antenna device according to the present invention can be easily manufactured.

The antenna device according to the present invention preferably further includes first and second contact plugs that penetrate the magnetic sheet to be connected respectively to the outer and inner peripheral ends of the antenna coil. According to this configuration, in a case where the communication circuit to be connected to the antenna coil is provided on the one main surface of the antenna coil, electrical connection between the communication circuit and the antenna coil can be reliably achieved by the first and second contact plugs.

In the antenna device according to the present invention, the outer and inner peripheral ends of the antenna coil may be exposed without being covered by the resin layer. According to this configuration, electrical connection between the communication circuit and the antenna coil can be easily and reliably achieved.

A manufacturing method according to the present invention is a method of manufacturing an antenna device including an antenna coil and a magnetic sheet, the method includes the steps of: forming, on a surface of a resin support film, a resin layer having the same planar shape as that of the antenna coil; forming, by plating, the antenna coil on a surface of the resin layer; forming the magnetic sheet on one main surface side of the antenna coil; and removing the support film from the resin layer.

According to the present invention, it is possible to manufacture, with ease and at low cost, an antenna device having a very small thickness and excellent in heat radiation characteristics and excellent antenna characteristics.

In the present invention, it is preferable that the resin layer contains a catalyst for electroless plating and that the step of forming the antenna coil by plating includes a step of forming, by electroless plating, a ground plating layer constituting the antenna coil on the surface of the resin layer and a step of making the ground plating layer grow by electrolytic plating. According to this configuration, it is possible to form the antenna coil on the surface of the support film and thereby to manufacture an antenna device having a very small thickness and excellent in antenna characteristics.

In the present invention, the step of forming the antenna coil by plating preferably includes a step of adhering the catalyst for electroless plating to the surface of the resin layer, a step of forming, by electroless plating, a ground plating layer constituting the antenna coil on the surface of the resin layer to which the catalyst has been adhered, and a step of making the ground plating layer grow by electrolytic plating. According to this configuration, it is possible to form the antenna coil on the surface of the support film and thereby to manufacture an antenna device having a very small thickness and excellent in antenna characteristics.

The manufacturing method according to the present invention preferably further includes a step of removing the resin layer that covers outer and inner peripheral ends of the antenna coil after removal of the support film. According to this configuration, electrical connection between the antenna coil and a communication circuit can be easily achieved.

As explained above, according to the present invention, it is possible to provide an antenna device having a very small thickness and having excellent heat radiation characteristics and excellent antenna characteristics and a manufacturing method thereof.

BRIEF DESCRIPTION OF THE DRAWINGS

The above features and advantages of the present invention will be more apparent from the following description of certain preferred embodiments taken in conjunction with the accompanying drawings, in which:

FIGS. 2A to 2C are planar views separately illustrating individual layers constituting the antenna device according to the first embodiment in which FIG. 2A illustrates a magnetic sheet, FIG. 2B illustrates an antenna coil, and FIG. 2C illustrates a resin layer;

FIGS. 3A and 3B are cross-sectional views of the antenna device according to the first embodiment in which FIG. 3A is a cross-sectional view taken along a line A-A' of FIGS. 2A to 2C, and FIG. 3B is a cross-sectional view taken along a B-B' line of FIGS. 2A to 2C;

FIGS. 6A to 6C are cross-sectional views illustrating an implementation example of the antenna device shown in FIG. 1 in which FIG. 6A illustrates a case where the antenna device is brought into contact with a battery pack, and FIGS. 6B and 6C illustrate a case where the antenna device is brought into contact with a printed circuit board;

DETAILED DESCRIPTION OF THE EMBODIMENTS

Figure 1:
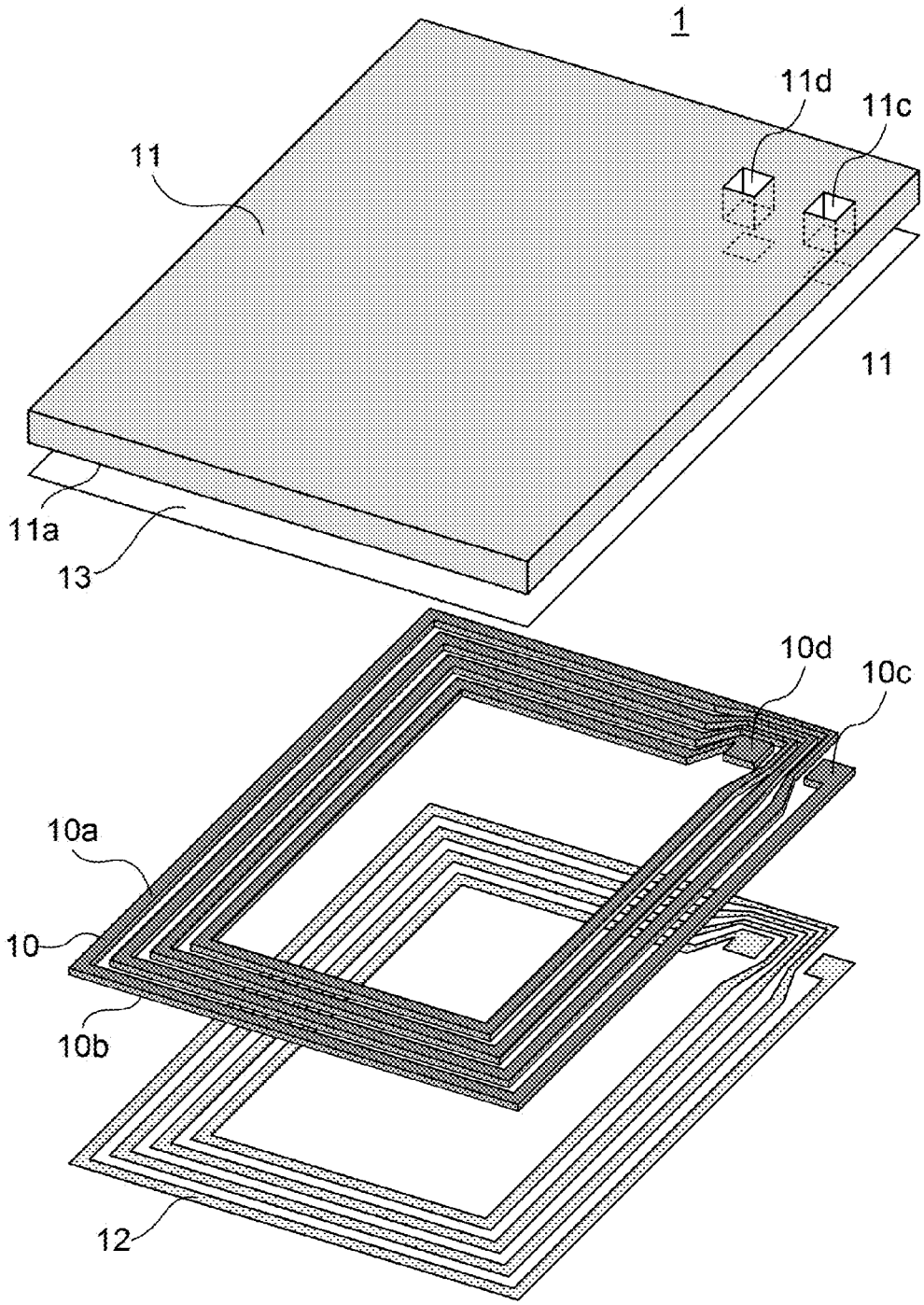
FIG. 1 is an exploded perspective view illustrating a configuration of an antenna device according to a first embodiment of the present invention.
Figure 2A:
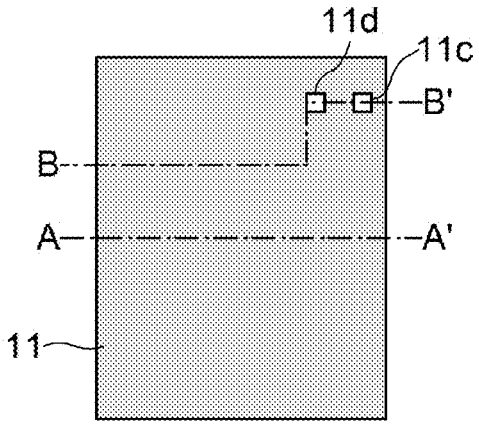
Figure 2B:
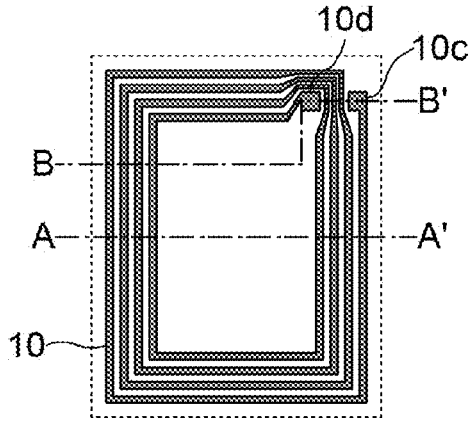
Figure 2C:
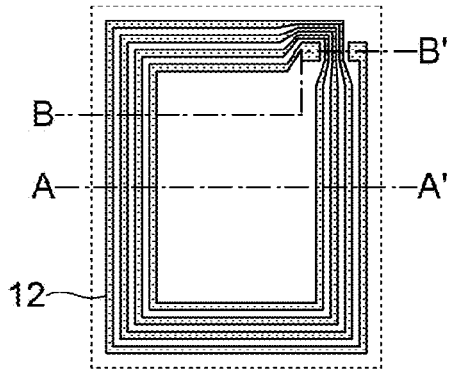
Figure 3A:
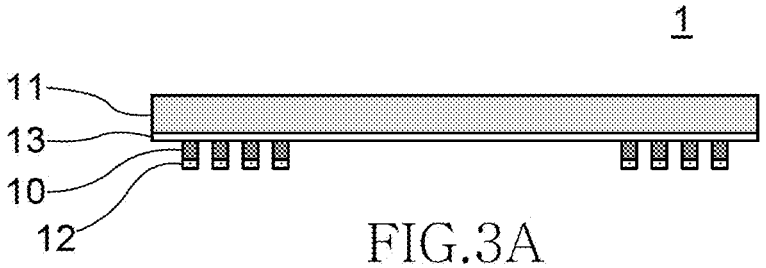
Figure 3B:
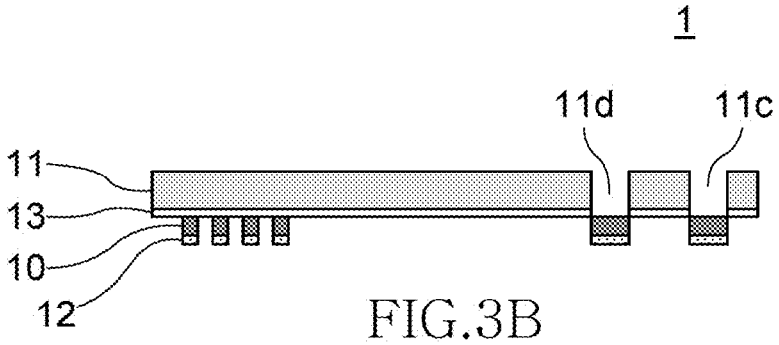

FIG. 1 is an exploded perspective view illustrating a configuration of an antenna device according to the first embodiment of the present invention. FIGS. 2A to 2C are planar views separately illustrating individual layers constituting the antenna device according to the first embodiment. FIG. 2A illustrates a magnetic sheet, FIG. 2B illustrates an antenna coil, and FIG. 2C illustrates a resin layer. FIGS. 3A and 3B are cross-sectional views of the antenna device according to the first embodiment. FIG. 3A is a cross-sectional view taken along a line A-A' of FIGS. 2A to 2C, and FIG. 3B is a cross-sectional view taken along a B-B' line of FIGS. 2A to 2C.

As illustrated in FIG. 1, FIGS. 2A to 2C, and FIGS. 3A and 3B, an antenna device 1 according to the present embodiment includes an antenna coil 10 constituted of a planar coil pattern, a magnetic sheet 11 provided on one main surface 10*a* of the antenna coil 10, and a resin layer 12 provided on the other main surface 10*b* of the antenna coil 10. An adhesive layer 13 is formed on one main surface 11*a* of the magnetic sheet 11 so that the antenna coil 10 is provided on the main surface 11*a* of the magnetic sheet 11 through the adhesive layer 13.

The antenna coil 10 is constituted of a substantially rectangular spiral pattern and is formed while depicting a loop as large as possible along the magnetic sheet 11 so as to make a size of an opening inside the spiral large. The antenna coil 10 is preferably made of Cu (copper) having high conductivity and advantageous in terms of workability and cost. A thickness of the antenna coil 10 is preferably in a range of 30 μm to 50 μm. Although details will be described later, an outer peripheral end 10*c* and an inner peripheral end 10*d* of the antenna coil 10 are connected to a communication circuit such as an NFC chip.

The magnetic sheet 11 provides a magnetic path of a magnetic flux that the antenna coil 10 generates and can be made from magnetic metal powder containing resin obtained by dispersing magnetic metal powder in a resin binder. As the magnetic metal powder, Permalloy (Fe—Ni alloy), Super Permalloy (Fe—Ni—Mo alloy), Sendust (Fe—Si—Al alloy), Fe—Si alloy, Fe—Co alloy, Fe—Cr alloy, Fe—Cr—Si alloy or the like can be used. As the resin binder, phenol resin, urea resin, melamine resin, polytetrafluoroethylene, polyethylene, polypropylene, polystyrene, polyether sulfone, polyphenylene sulfide, PET (polyethylene terephthalate), PET (polybutylene terephthalate), polyarylate, silicone resin, diallyl phthalate, polyimide, or the like can be used.

For a reduction in thickness of the antenna device 1, a thickness of the magnetic sheet 11 is preferably as thin as possible within a range where function of the magnetic sheet 11 can be fulfilled. Specifically, the thickness of the magnetic sheet 11 is preferably in a range from 30 μm to 80 μm. The magnetic sheet 11 has contact holes 11*c* and 11*d* to expose therethrough the outer peripheral end 10*c* and the inner peripheral end 10*d* of the antenna coil 10. The outer peripheral end 10*c* and the inner peripheral end 10*d* of the antenna coil 10 are connected to contact plugs (not illustrated) embedded in the contact holes 11*c* and 11*d*, respectively and are electrically connected to a communication circuit (not illustrated) through the contact plugs penetrating the magnetic sheet 11.

The resin layer 12 may mechanically protects a surface of the antenna coil 10 and serves as a base film of the antenna coil 10 upon formation thereof. The resin layer 12 is made of, e.g., epoxy resin and preferably has a thickness of 1 μm to 5 μm. A planar shape of the resin layer 12 need not completely coincide with a planar shape of the antenna coil 10. For example, a part (particularly, outer peripheral end 10*c* and inner peripheral end 10*d*) of the surface of the antenna coil 10 may be exposed through a removed portion of the resin layer 12. Thus, it is only necessary for the resin layer 12 to be formed in a formation area of the antenna coil 10 in a planar view.

The resin layer 12 may contain a metal such as palladium that acts as a catalyst when the antenna coil 10 is formed by plating. In the case where the resin layer 12 does not contain such a metal and thus has insulating properties, the resin layer can serve as an insulating film that electrically protects the antenna coil 10.

FIGS. 4A to 4E are exemplary views for explaining an example of a manufacturing method for the antenna device 1.

Figure 4A:
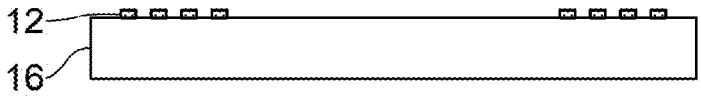
FIGS. 4A to 4E are exemplary views for explaining an example of a manufacturing method for the antenna device shown in FIG. 1.

First, as illustrated in FIG. 4A, a resin support film 16 is prepared, and the resin layer 12 having the same planar shape as that of the antenna coil 10 is formed on a surface of the support film 16. As the support film 16, a PET film having a thickness of 30 μm to 50 μm is preferably used. The resin layer 12 contains a catalyst, such as palladium, for electroless plating. The resin layer 12 can be formed by screen-printing an epoxy resin paste containing palladium followed by curing. In order to facilitate a removal process (to be described later) of the support film 16, coating may be previously applied to the surface of the support film 16 before formation of the resin layer 12.

Figure 4B:
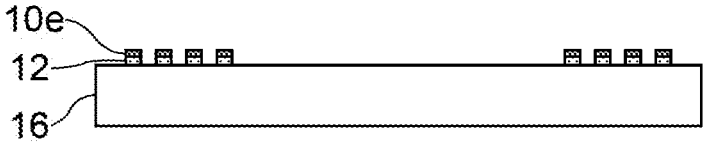
Figure 4C:
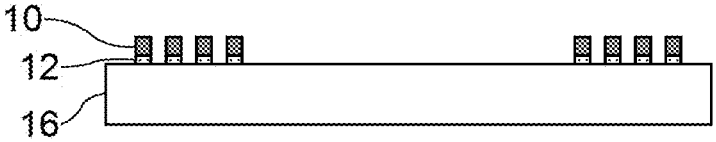

Then, as illustrated in FIG. 4B, electroless copper plating is applied to the support film 16 on which the resin layer 12 containing the catalyst has been formed to thereby form a base plating layer 10*e* of the antenna coil 10 on an upper surface of the resin layer 12. Further, as illustrated in FIG. 4C, the base plating layer 10*e* of the antenna coil 10 is made to grow by electrolytic copper plating to thereby complete formation of the antenna coil 10.

Figure 4D:
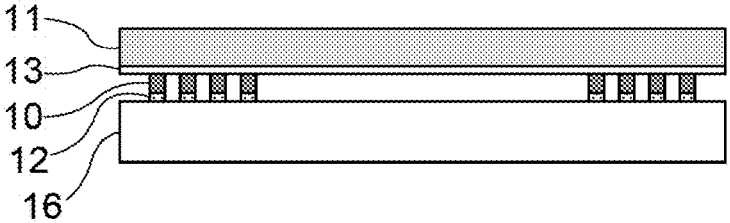
Figure 4E:
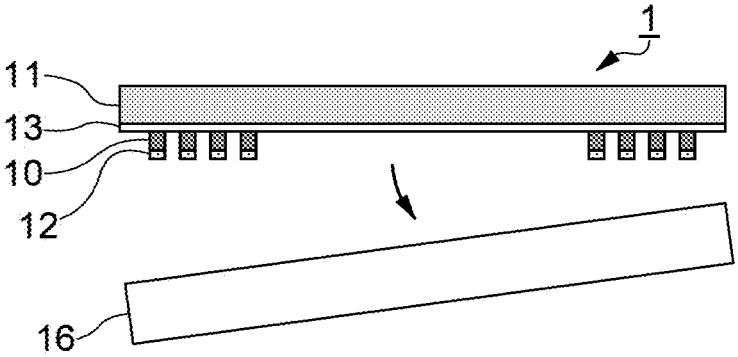

Then, as illustrated in FIG. 4D, the magnetic sheet 11 on the main surface 11*a* of which the adhesive layer 13 has been formed is prepared, and the antenna coil 10 is bonded to a surface of the adhesive layer 13. After that, as illustrated in FIG. 4E, the support film 16 is removed from the antenna coil 10. Formation of the antenna device 1 is thus completed.

FIGS. 5A to 5F are exemplary views for explaining another example of the manufacturing method for the antenna device 1.

Figure 5A:
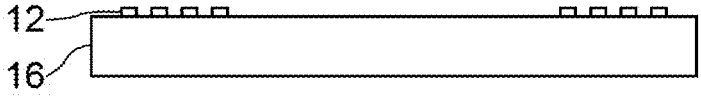
FIGS. 5A to 5F are exemplary views for explaining another example of a manufacturing method for the antenna device shown in FIG. 1.
Figure 5B:
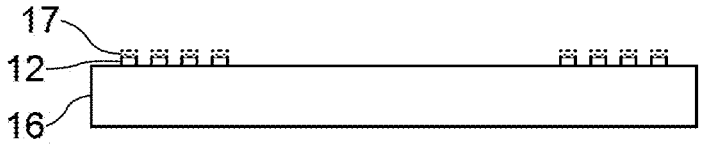
Figure 5C:
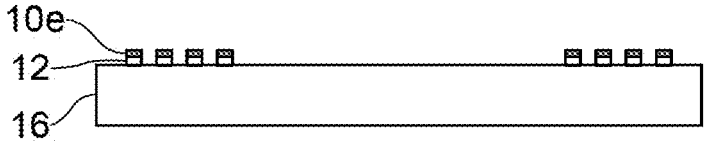
Figure 5D:
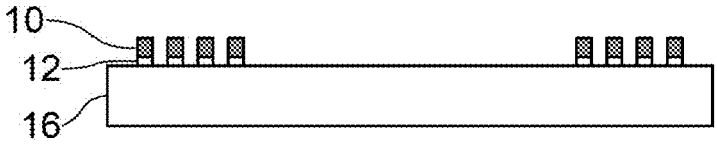
Figure 5E:
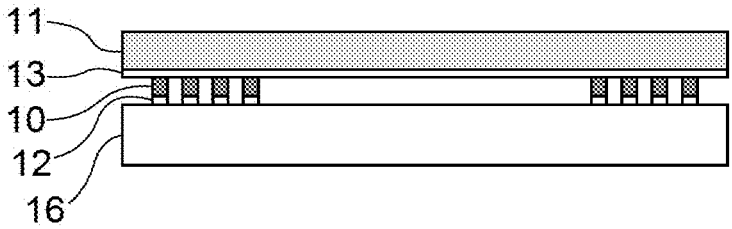
Figure 5F:
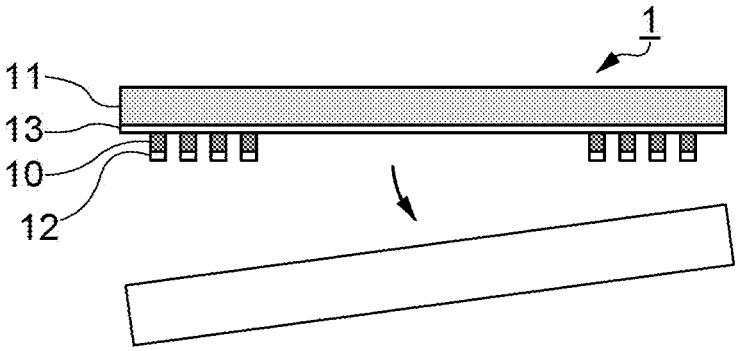

As illustrated in FIGS. 5A to 5F, this manufacturing method is featured in that the resin layer not containing the catalyst for electroless plating is formed (FIG. 5A), and a catalyst 17 is adhered to the surface of the formed resin layer 12 (FIG. 5B), followed by electroless plating (FIG. 5C). Other processes (FIGS. 5D to 5F) are the same as those illustrated in FIGS. 4C to 4E, so redundant description thereof will be omitted. Using a material to which the catalyst is easily adhered as a material of the resin layer 12 allows the catalyst that is coated or dispersed to the entire surface of the support film 16 to be adhered only to the surface of the resin layer 12. After that, by performing electroless plating and electrolytic plating, the antenna coil 10 having a desired planar coil pattern can be formed. In the antenna device 1 manufactured by this manufacturing method, the surface of the resin layer 12 exposed after removal of the support film 16 assumes insulating properties. Thus, it is possible to insulate the antenna coil 10 from other circuits or a casing by the resin layer 12.

In the antenna device 1 according to the present embodiment, although the antenna coil 10 is provided on the magnetic sheet 11, the resin support film 16 that supports the antenna coil 10 at its formation stage is not provided. A recent mobile electronic apparatus represented by a smartphone is required to be reduced in thickness to the limit and, in the present embodiment, the support film 16 is removed in the manufacturing process, so that the antenna device 1 can be reduced in thickness and weight by just those of the support film 16, leading to a reduction in thickness and weight of a mobile electronic apparatus such as a smartphone in which the antenna device is incorporated.

Further, the resin support film 16 is a dielectric body, so that if the support film 16 is brought into contact with the antenna coil 10, an inter-line capacitance of the antenna coil 10 becomes large. In frequency matching of the antenna device 1, a desired resonance frequency is set by adding a capacitance to an antenna circuit. However, if an original capacitance is very large due to a large inter-line capacitance, adjustment of a frequency made by addition of the capacitance is difficult. That is, it is difficult to achieve matching at a target frequency (e.g., 13.56 MHz) by adding the capacitance in frequency matching. However, when the support film 16 is not provided, the inter-line capacitance can be reduced, thereby facilitating antenna frequency matching.

Figure 6A:
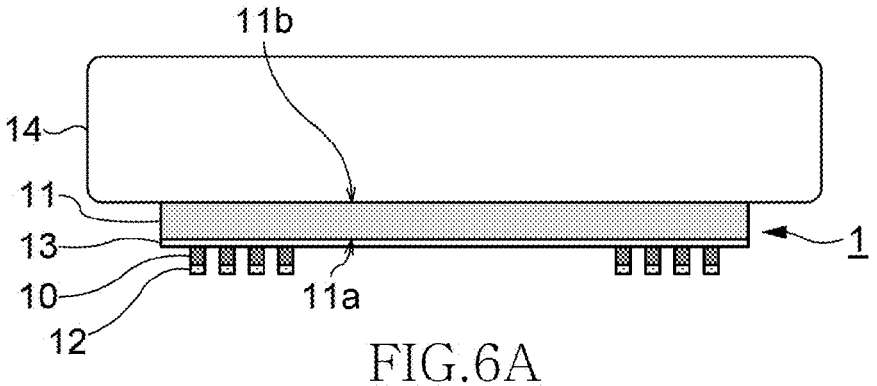
Figure 6B:
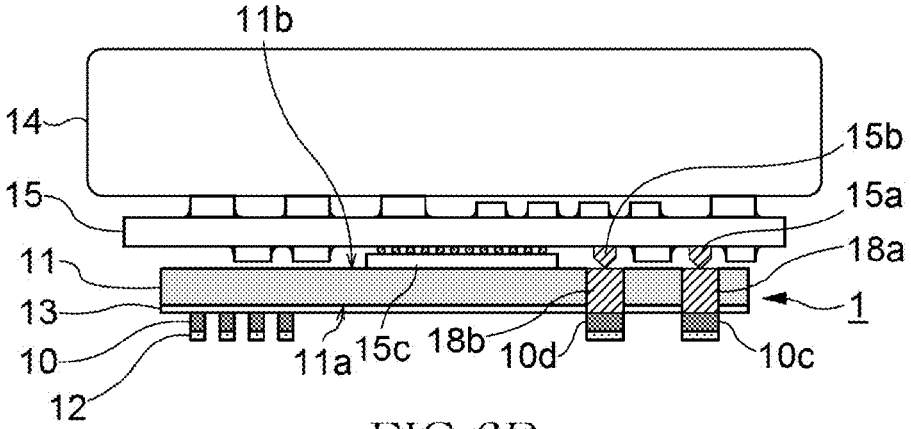
Figure 6C:
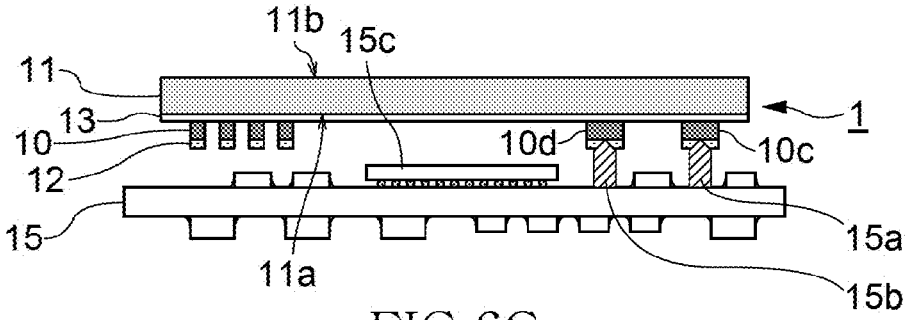

FIGS. 6A to 6C are cross-sectional views illustrating an implementation example of the antenna device 1. FIG. 6A illustrates a case where the antenna device 1 is brought into contact with a battery pack, and FIGS. 6B and 6C illustrate a case where the antenna device 1 is brought into contact with a printed circuit board.

As illustrated in FIG. 6A, the antenna device 1 according to the present embodiment can be fitted to a surface of a battery pack 14. In this case, the battery pack 14 needs to be disposed on the other main surface 11*b* side of the magnetic sheet 11. In the absence of the magnetic sheet 11, the antenna coil 10 may not function as a desired antenna under influence of a metallic casing of the battery pack 14; however, in the present embodiment, the magnetic sheet 11 is provided between the antenna coil 10 and the battery pack 14, whereby influence of the metallic body can sufficiently be reduced.

The battery pack 14 generates heat with charge and discharge of a battery. However, because the support film 16 is not provided in the antenna device 1, heat radiation from the battery pack 14 is not blocked by the resin support film 16. Thus, the antenna device 1 has high heat radiation performance.

Further, as illustrated in FIG. 6B, the antenna device 1 according to the present embodiment can be fitted onto a printed circuit board 15. As illustrated, the battery pack 14 is provided on the other main surface 11*b* side of the magnetic sheet 11, and the printed circuit board 15 is provided between the battery pack 14 and the antenna device 1. While the magnetic sheet 11 is provided between the antenna coil 10 and the printed circuit board 15, the outer peripheral end 10*c* and the inner peripheral end 10*d* of the antenna coil 10 are respectively connected to contact pins 15*a* and 15*b* of the printed circuit board 15 via first and second contact plugs 18*a* and 18*b* embedded in the contact holes 11*c* and 11*d* of the magnetic sheet 11, respectively, whereby the antenna coil 10 can be easily connected to the printed circuit board 15. Alternatively, it is possible to bring the contact pins 15*a* and 15*b* of the printed circuit board 15 into direct contact with the outer peripheral end 10*c* and inner peripheral end 10*d* of the antenna coil 10 without using the contact plugs 18*a* and 18*b*.

Assume that a semiconductor IC chip 15*c* is mounted on the printed circuit board 15 and generates heat as illustrated in FIG. 6B. Also in this case, since the resin support film 16 is not provided in the antenna device 1, heat radiation from the semiconductor IC chip 15*c* is not blocked. Thus, the antenna device 1 has high heat radiation performance.

As illustrated in FIG. 6C, the antenna device 1 according to the present embodiment can be provided such that the antenna coil 10 side thereof faces the printed circuit board 15. In this case, the contact pins 15*a* and 15*b* of the printed circuit board 15 penetrate the resin layer 12 to be electrically connected to the outer peripheral end 10*c* and the inner peripheral end 10*d* of the antenna coil 10, respectively. Alternatively, it is possible to partially remove the resin layer 12 that covers the outer peripheral end 10*c* and the inner peripheral end 10*d* of the antenna coil 10 and then to connect the contact pins 15*a* and 15*b* to exposed surfaces of the outer peripheral end 10*c* and the inner peripheral end 10*d*, respectively. In the implementation example illustrated in FIG. 6C, the contact holes 11*c* and 11*d* need not be formed in the magnetic sheet 11.

As described above, in the antenna device 1 according to the present embodiment, the antenna coil 10 is supported by the magnetic sheet 11, and the resin support film 16 is removed and absent, whereby a reduction in thickness of the antenna device can be achieved. Further, the support film 16 is removed and absent, so that heat radiation is not blocked by the support film 16 even when the antenna coil 10 is provided on the surface of a heating body such as the battery pack 14. Further, the support film 16 having a high dielectric constant is removed and absent, so that it is possible to solve the problem that it is difficult to achieve frequency matching due to a large line capacitance of the coil by the support film 16.

Figure 7:
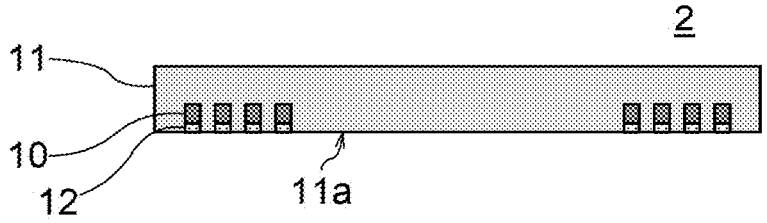
FIG. 7 is a cross-sectional view illustrating a configuration of an antenna device according to a second embodiment of the present invention.
Figure 8:
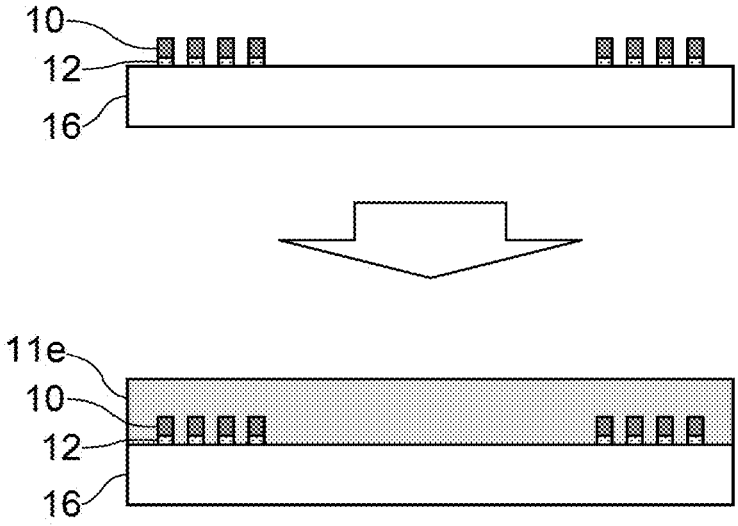
FIG. 8 is an exemplary view for explaining a manufacturing method for the antenna device according to the second embodiment.

FIG. 7 is a cross-sectional view illustrating a configuration of the antenna device 2 according to the second embodiment of the present invention. FIG. 8 is an exemplary view for explaining a manufacturing method for the antenna device 2 according to the second embodiment.

As illustrated in FIG. 7, an antenna device 2 according to the present embodiment is featured in that the antenna coil 10 and the resin layer 12 are embedded in the magnetic sheet 11 on the main surface 11*a* side such that the resin layer 12 is exposed on the main surface 11*a*. The adhesive layer 13, which is used in the first embodiment, is not provided. Other configurations are substantially the same as those of the antenna device 1 according to the first embodiment. Thus, the antenna device 2 according to the present embodiment can provide the same functions and effects as those of the antenna device 1.

As illustrated in FIG. 8, the resin layer 12 and the antenna coil 10 are formed on the support film 16, and a magnetic metal powder resin paste 11*e* is coated on the entire surface of the support film 16 so as to cover the resin layer 12 and the antenna coil 10. Thereafter, the magnetic metal powder resin paste 11*e* is cured, and the support film 16 is removed, whereby formation of the antenna device 2 is completed. Processes of forming the resin layer 12 and the antenna coil 10 on the support film 16 are as illustrated in FIGS. 4A to 4C or FIGS. 5A to 5C.

It is apparent that the present invention is not limited to the above embodiments, but may be modified and changed without departing from the scope and spirit of the invention.

For example, although the antenna coil 10 is constituted by a spiral pattern with several turns in the above embodiments, the loop pattern may contain no turns. That is, the antenna coil 10 only needs to be a loop-shaped or a spiral-shaped planar coil pattern.

Further, in the above embodiments, the contact holes 11*c* and 11*d* are formed in the magnetic sheet 11 so that the contact holes 11*c* and 11*d* are provided in a limited range where they overlap pads of the respective outer peripheral end 10*c* and the inner peripheral end 10*d* of the antenna coil 10 in a planar view. Alternatively, however, the pads of the respective outer peripheral end 10*c* and the inner peripheral end 10*d* may be exposed together through one large contact hole. That is, in a configuration where the contact hole is formed on the magnetic sheet 11, the contact hole may be formed so as to overlap the outer peripheral end 10*c* and the inner peripheral end 10*d* in a planar view.

What is claimed is:

1. An antenna device comprising:

an antenna coil having a planar coil pattern;

a magnetic sheet that covers one main surface of the antenna coil; and a resin layer provided on the other main surface of the antenna coil and along the coil pattern, wherein the magnetic sheet is configured so as to avoid an area overlapping with an outer peripheral end and an inner peripheral end of the antenna coil in a planar view.

2. The antenna device as claimed in claim 1, wherein the antenna coil is bonded to one main surface of the magnetic sheet via an adhesive layer.

3. The antenna device as claimed in claim 2, wherein a metallic body is positioned on the other main surface side of the magnetic sheet.

4. The antenna device as claimed in claim 2, wherein a printed circuit board is positioned on the other main surface side of the magnetic sheet.

5. The antenna device as claimed in claim 1, wherein the resin layer contains metal that acts as a catalyst when the antenna coil is formed by plating.

6. The antenna device as claimed in claim 1, further comprising first and second contact plugs that penetrate the magnetic sheet to be connected respectively to the outer and inner peripheral ends of the antenna coil.

7. The antenna device as claimed in claim 1, wherein outer and inner peripheral ends of the antenna coil are exposed without being covered by the resin layer.

8. A method of manufacturing an antenna device including an antenna coil and a magnetic sheet, the method comprising:

forming a resin layer having the same planar shape as that of the antenna coil on a surface of a support film;

forming the antenna coil on a surface of the resin layer by plating;

forming the magnetic sheet on one main surface side of the antenna coil; and removing the support film from the resin layer.

9. The method of manufacturing the antenna device as claimed in claim 8, wherein the resin layer contains a catalyst for electroless plating, and wherein the forming the antenna coil by plating includes:

forming a base plating layer on the surface of the resin layer by electroless plating; and growing the base plating layer by electrolytic plating.

10. The method of manufacturing the antenna device as claimed in claim 8, wherein the forming the antenna coil by plating includes:

adhering the catalyst for electroless plating to the surface of the resin layer;

forming a base plating layer on the surface of the resin layer to which the catalyst has been adhered by electroless plating; and growing the base plating layer by electrolytic plating.

11. The method of manufacturing the antenna device as claimed in claim 8, further comprising removing the resin layer that covers outer and inner peripheral ends of the antenna coil after the removing.

12. A device comprising:

a spiral metal pattern having first and second spiral surfaces opposite to each other;

a magnetic sheet arranged on the first spiral surface of the spiral metal pattern; and a spiral resin pattern having third and fourth spiral surfaces opposite to each other, the third spiral surface of the spiral resin pattern being in contact with the second spiral surface of the spiral metal pattern.

13. The device as claimed in claim 12, wherein the spiral resin pattern is substantially the same planar shape as the spiral metal pattern.

14. The device as claimed in claim 12, wherein the spiral resin pattern includes a metal material.

15. The device as claimed in claim 14, wherein the metal material comprises palladium.

16. The device as claimed in claim 12, wherein the spiral resin pattern is substantially free from a metal material.

17. The device as claimed in claim 12, wherein the magnetic sheet has at least one contact hole that expose an outer peripheral end and an inner peripheral end of the first spiral surface of the spiral metal pattern.

18. The device as claimed in claim 12, wherein the second spiral surface of the spiral metal pattern has an outer peripheral end and an inner peripheral end that expose from the spiral resin pattern.

19. The device as claimed in claim 12, wherein the spiral metal pattern is thicker than the spiral resin pattern.

20. An antenna device comprising:

an antenna coil having a planar coil pattern;

a magnetic sheet that covers one main surface of the antenna coil;

a resin layer provided on the other main surface of the antenna coil and along the coil pattern;

an adhesive layer configured to bond the antenna coil to one main surface side of the magnetic sheet; and a metallic body positioned on the other main surface side of the magnetic sheet.

21. An antenna device comprising:

an antenna coil having a planar coil pattern;

a magnetic sheet that covers one main surface of the antenna coil;

a resin layer provided on the other main surface of the antenna coil and along the coil pattern;

an adhesive layer configured to bond the antenna coil to one main surface side of the magnetic sheet; and a printed circuit board positioned on the other main surface side of the magnetic sheet.

22. An antenna device comprising:

an antenna coil having a planar coil pattern;

a magnetic sheet that covers one main surface of the antenna coil; and a resin layer provided on the other main surface of the antenna coil and along the coil pattern, the resin layer containing metal that acts as a catalyst when the antenna coil is formed by plating.

23. An antenna device comprising:

an antenna coil having a planar coil pattern;

a magnetic sheet that covers one main surface of the antenna coil; and a resin layer provided on the other main surface of the antenna coil and along the coil pattern, wherein outer and inner peripheral ends of the antenna coil are exposed without being covered by the resin layer.

* * * * *